US006290004B1

(12) United States Patent
Evans

(10) Patent No.: US 6,290,004 B1
(45) **Date of Patent: *Sep. 18, 2001**

(54) HYDRAULIC JAR

(76) Inventor: Robert W. Evans, 18740 Palm Beach Blvd., Montgomery, TX (US) 77356

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,568

(22) Filed: Sep. 2, 1999

(51) Int. Cl.[7] ..... E21B 31/107

(52) U.S. Cl. ..... 175/296; 166/301; 166/178

(58) Field of Search ..... 175/296, 297, 175/300, 302, 299, 304; 166/301, 178, 382, 386

(56) References Cited

U.S. PATENT DOCUMENTS

| | | | |
|---|---|---|---|
| Re. 3,510 | 6/1869 | Bryan . | |
| Re. 9,072 | 2/1880 | McMullen . | |
| Re. 15,760 | 2/1924 | Kammerdiner . | |
| Re. 23,354 | 4/1951 | Storm | 255/27 |
| Re. 28,768 | 4/1976 | Mason | 175/297 |
| 2,499,695 | 3/1950 | Storm | 255/27 |
| 2,551,868 | 5/1951 | Brady | 255/27 |
| 2,659,576 | 11/1953 | Linney | 255/27 |
| 2,801,595 | 8/1957 | Knabe et al. | 103/158 |
| 2,915,289 | 12/1959 | Lawrence | 255/27 |
| 2,989,132 | 6/1961 | Dowden | 175/297 |
| 3,145,787 | 8/1964 | Brown | 175/107 |
| 3,208,541 | 9/1965 | Lawrence | 175/299 |
| 3,233,690 | 2/1966 | Lawrence | 175/299 |
| 3,251,426 | 5/1966 | Lebourg | 175/297 |
| 3,268,003 | 8/1966 | Essary | 166/35 |
| 3,285,353 | 11/1966 | Young | 175/297 |
| 3,307,636 | 3/1967 | Le Blanc | 173/13 |
| 3,316,986 | 5/1967 | Orr | 175/297 |
| 3,342,266 | 9/1967 | Le Blanc | 166/46 |
| 3,343,606 | 9/1967 | Dollison | 166/98 |
| 3,349,858 | 10/1967 | Chenoweth | 175/297 |
| 3,360,060 | 12/1967 | Kinley et al. | 175/299 |
| 3,361,220 | 1/1968 | Brown | 175/237 |
| 3,371,730 | 3/1968 | Newman | 175/300 |
| 3,380,247 | 4/1968 | Colmerauer | 60/52 |
| 3,385,384 | 5/1968 | Plunk | 175/297 |
| 3,392,795 | 7/1968 | Greer | 175/297 |
| 3,399,740 | 9/1968 | Barrington | 175/297 |
| 3,399,741 | 9/1968 | Monroe | 175/297 |
| 3,406,770 | 10/1968 | Arterbury et al. | 175/299 |
| 3,417,822 | 12/1968 | Howell | 166/43 |

(List continued on next page.)

FOREIGN PATENT DOCUMENTS

| | | | |
|---|---|---|---|
| 1221960 | 5/1987 | (CA) | 255/29 |

OTHER PUBLICATIONS

Bowen Tools, Inc., General Catalog, pp. 488–489; 1994.

*Primary Examiner*—Robert E. Pezzuto
(74) *Attorney, Agent, or Firm*—Timothy M. Honeycutt

(57) ABSTRACT

Various jars are provided for delivering axial blows to a well string. In one aspect, a jar is provided that includes a mandrel and a housing telescopically positioned about the mandrel. A piston is positioned between the mandrel and the housing and closes a substantially sealed chamber in the housing. The piston has a first flow passage and a second flow passage which enable the selective flow of a fluid into and out of the substantially sealed chamber. A collet is positioned in the housing for selectively engaging the mandrel. A sleeve is positioned around and axially moveable relative to the collet. The sleeve has a reduced inner diameter portion at which the collet selectively expands radially to disengage the mandrel. Axial movement of the mandrel engages the collet, which in turn, moves the piston and pressurizes the chamber. When the reduced diameter portion of the sleeve is reached, the collet releases the mandrel, enabling the mandrel to impact an anvil surface of the housing.

20 Claims, 7 Drawing Sheets

U.S. PATENT DOCUMENTS

| | | | |
|---|---|---|---|
| 3,429,389 | 2/1969 | Barrington | 175/297 |
| 3,446,283 | 5/1969 | Baumstimler | 166/311 |
| 3,461,962 | 8/1969 | Harrington | 166/226 |
| 3,539,025 | 11/1970 | Sutliff et al. | 175/297 |
| 3,562,807 | 2/1971 | Slator et al. | 175/297 |
| 3,566,981 | 3/1971 | Love | 175/297 |
| 3,642,069 | 2/1972 | Adkins | 166/301 |
| 3,648,786 | 3/1972 | Chenoweth | 175/56 |
| 3,651,867 | 3/1972 | Baumstimler | 166/99 |
| 3,658,140 | 4/1972 | Berryman | 175/304 |
| 3,660,990 | 5/1972 | Zerb et al. | 64/23 |
| 3,684,042 | 8/1972 | Graff | 175/302 |
| 3,685,598 | 8/1972 | Nutter | 175/302 |
| 3,685,599 | 8/1972 | Kisling, III | 175/304 |
| 3,709,478 | 1/1973 | Kisling, III | 267/137 |
| 3,716,109 | 2/1973 | Griffith | 175/297 |
| 3,724,576 | 4/1973 | Roberts | 175/293 |
| 3,727,685 | 4/1973 | Chestnut et al. | 166/255 |
| 3,729,058 | 4/1973 | Roberts | 175/297 |
| 3,735,827 | 5/1973 | Berryman | 175/296 |
| 3,768,932 | 10/1973 | Svercl et al. | 417/393 |
| 3,797,591 | 3/1974 | Berryman | 175/296 |
| 3,800,876 | 4/1974 | Eggleston | 166/301 |
| 3,804,185 | 4/1974 | Mason | 175/297 |
| 3,834,471 | 9/1974 | Bottoms | 175/304 |
| 3,837,414 | 9/1974 | Swindle | 175/299 |
| 3,853,187 | 12/1974 | Sutliff et al. | 175/297 |
| 3,860,076 | 1/1975 | White | 175/294 |
| 3,877,530 | 4/1975 | Downen | 175/297 |
| 3,880,249 | 4/1975 | Anderson | 175/302 |
| 3,889,766 | 6/1975 | Sutliff et al. | 175/297 |
| 3,949,821 | 4/1976 | Raugust | 175/297 |
| 3,955,634 | 5/1976 | Slator et al. | 175/297 |
| 3,963,081 | 6/1976 | Anderson et al. | 175/304 |
| 3,987,858 | 10/1976 | Slator et al. | 175/297 |
| 3,994,163 | 11/1976 | Rogers | 73/151 |
| 4,004,643 | 1/1977 | Newman | 175/321 |
| 4,007,798 | 2/1977 | Gazda | 175/297 |
| 4,023,630 | 5/1977 | Perkin et al. | 175/297 |
| 4,036,312 | 7/1977 | DeLuish | 175/302 |
| 4,059,167 | 11/1977 | Berryman | 175/297 |
| 4,081,043 | 3/1978 | Juergens | 175/297 |
| 4,098,338 | 7/1978 | Perkins | 166/301 |
| 4,105,070 | 8/1978 | Lavigne et al. | 166/250 |
| 4,105,082 | 8/1978 | Cheek | 175/302 |
| 4,109,736 | 8/1978 | Webb et al. | 175/297 |
| 4,111,271 | 9/1978 | Perkins | 175/297 |
| 4,113,038 | 9/1978 | Clark | 175/300 |
| 4,124,245 | 11/1978 | Kuenzel | 294/86.3 |
| 4,142,597 | 3/1979 | Johnston | 175/304 |
| 4,179,002 | 12/1979 | Young | 175/297 |
| 4,181,186 | 1/1980 | Blanton | 175/297 |
| 4,186,807 | 2/1980 | Sutliff et al. | 175/302 |
| 4,210,214 | 7/1980 | Blanton | 175/297 |
| 4,211,293 | 7/1980 | Blanton | 175/297 |
| 4,226,289 | 10/1980 | Webb et al. | 175/297 |
| 4,230,197 | 10/1980 | Wenzel | 175/297 |
| 4,241,797 | 12/1980 | Allen, Jr. | 175/237 |
| 4,284,153 | 8/1981 | Reaugh | 175/297 |
| 4,333,542 | 6/1982 | Taylor | 175/299 |
| 4,341,272 | 7/1982 | Marshall | 175/65 |
| 4,346,770 | 8/1982 | Beck | 175/297 |
| 4,361,195 | 11/1982 | Evans | 175/297 |
| 4,376,468 | 3/1983 | Clark | 175/304 |
| 4,394,883 | 7/1983 | Briscoe | 175/304 |
| 4,494,615 | 1/1985 | Jones | 173/119 |
| 4,498,548 | 2/1985 | Teng | 175/299 |
| 4,566,546 | 1/1986 | Evans | 175/297 |
| 4,582,148 | 4/1986 | Walter | 175/297 |
| 4,646,830 | 3/1987 | Templeton | 166/178 |
| 4,865,125 | 9/1989 | De Cuir | 166/178 |
| 4,923,373 | 5/1990 | Rothaar et al. | 417/439 |
| 5,007,479 | 4/1991 | Pleasants et al. | 166/178 |
| 5,086,853 | 2/1992 | Evans | 175/297 |
| 5,123,493 | 6/1992 | Wenzel | 175/297 |
| 5,170,843 | 12/1992 | Taylor | 166/301 |
| 5,217,070 | 6/1993 | Anderson | 166/178 |
| 5,232,060 | 8/1993 | Evans | 175/297 |
| 5,318,139 | 6/1994 | Evans | 175/297 |
| 5,327,982 | 7/1994 | Trahan et al. | 175/304 |
| 5,507,347 | 4/1996 | Estilette, Sr. | 166/301 |
| 5,624,001 | 4/1997 | Evans | 175/299 |

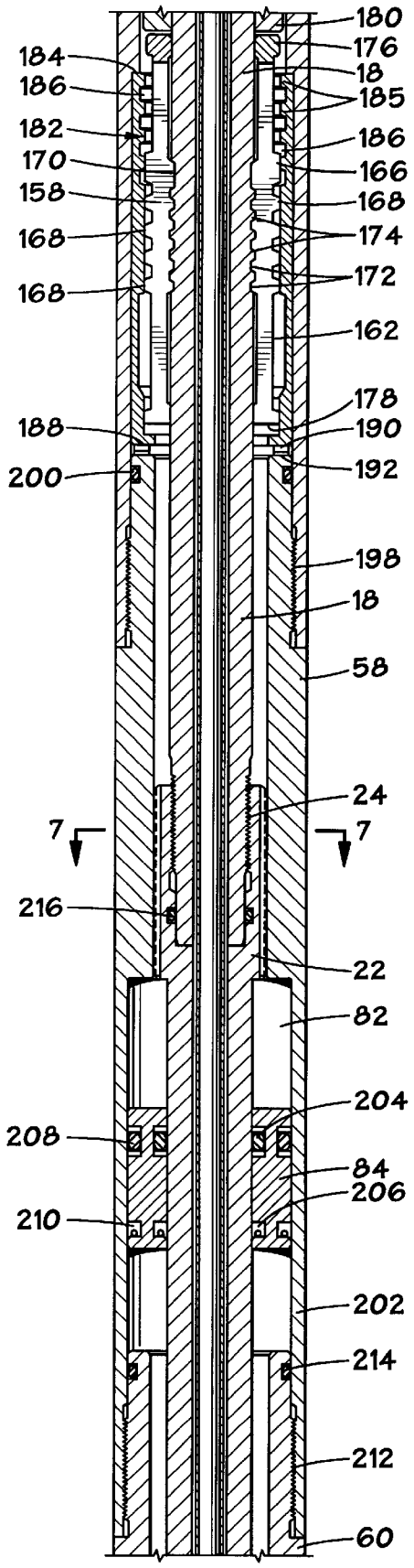
FIG. 1C
FIG. 9
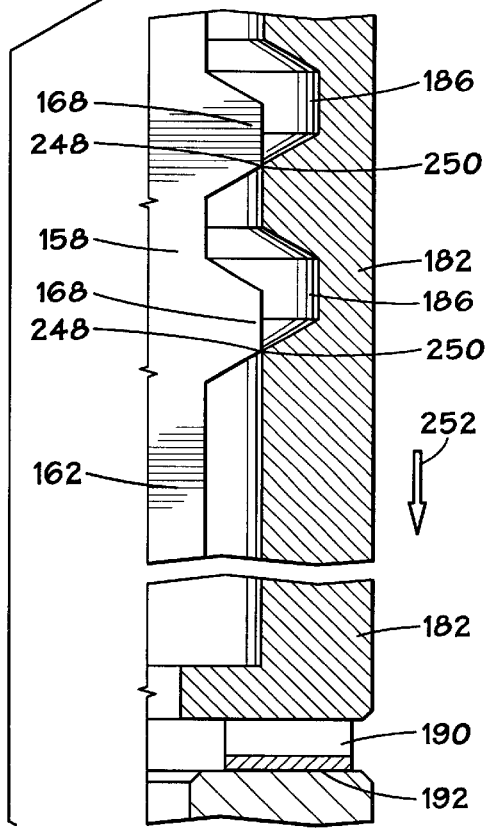

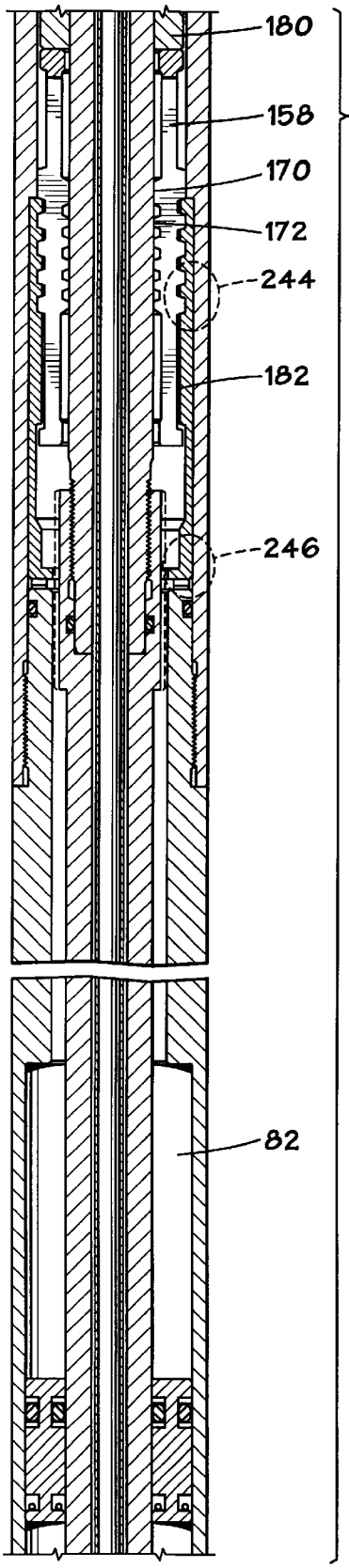
FIG. 8C
FIG. 4
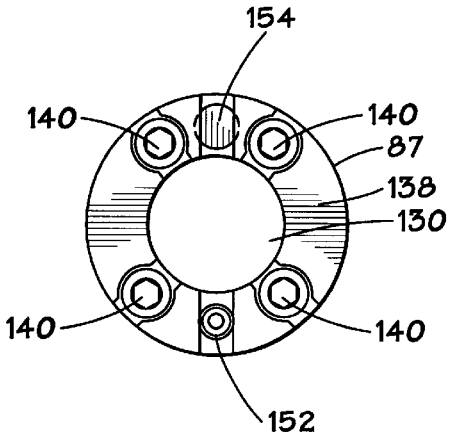
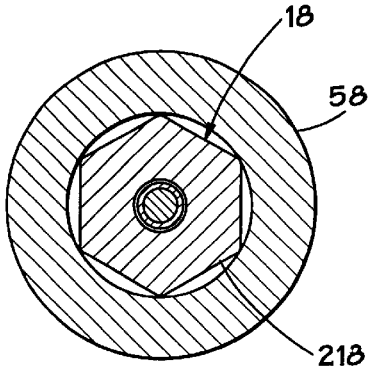
FIG. 7

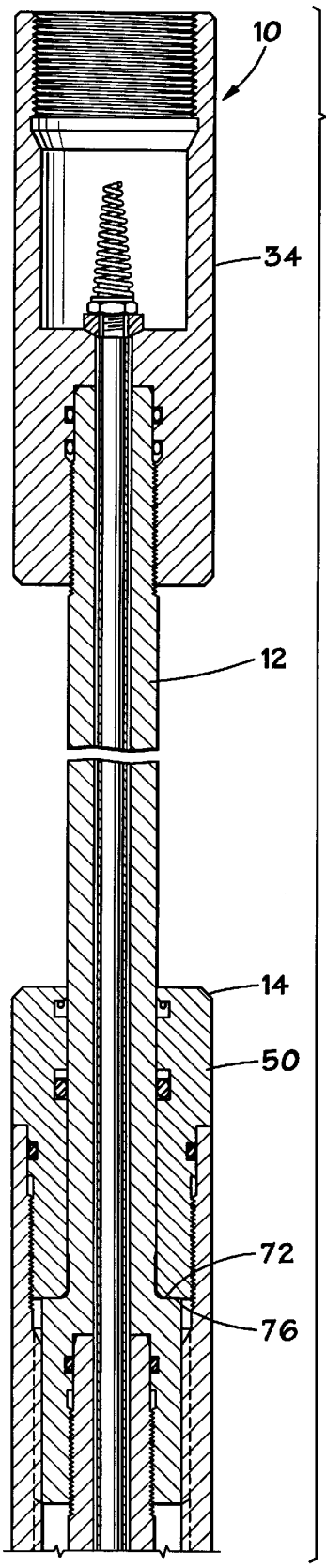
FIG. 8A
FIG. 8B
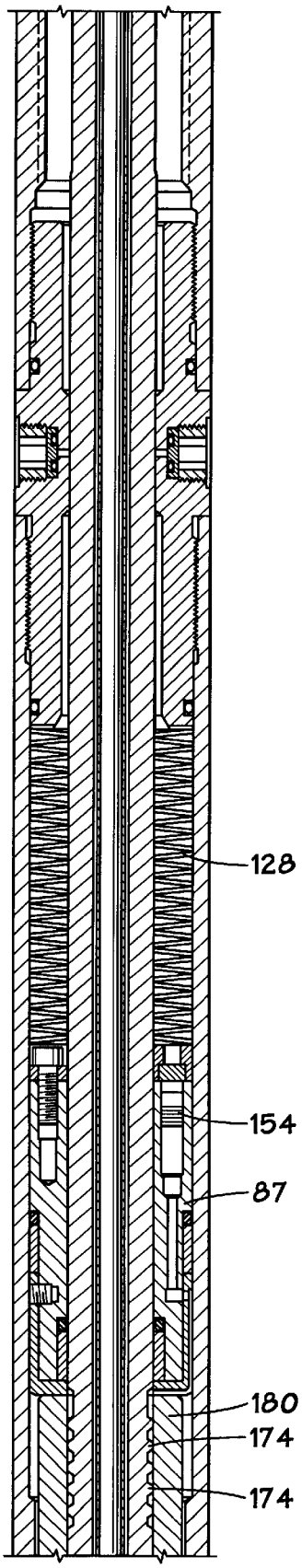

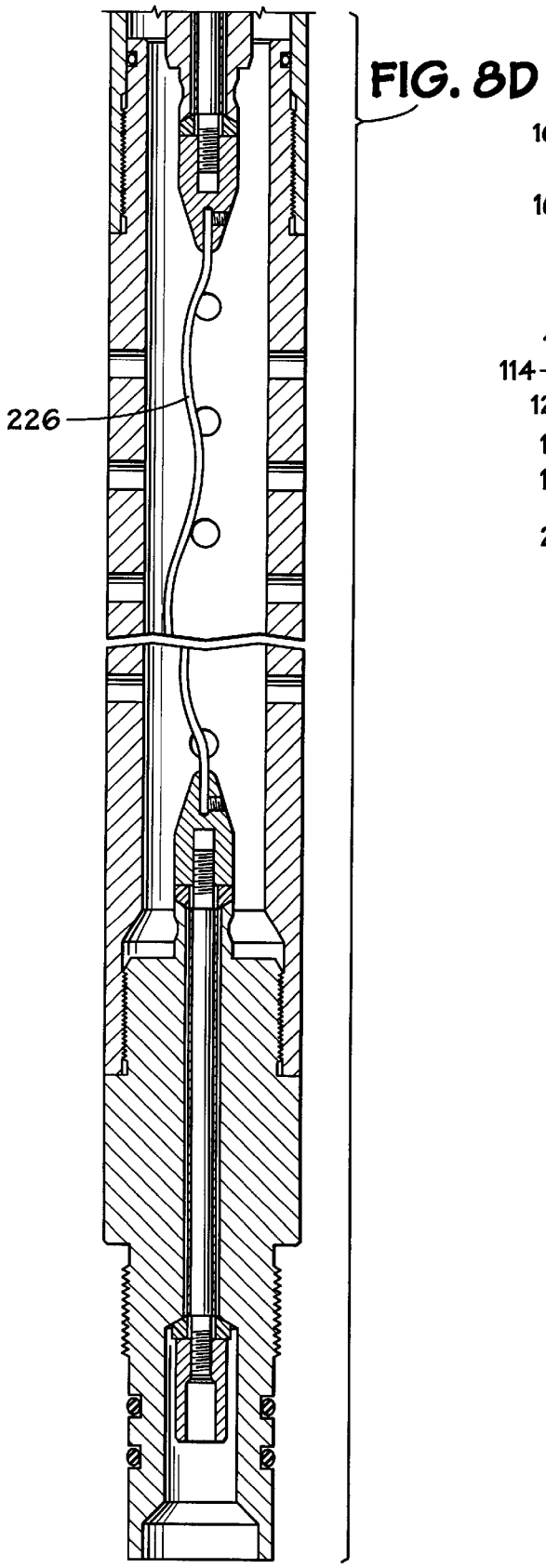
FIG. 8D
FIG. 10
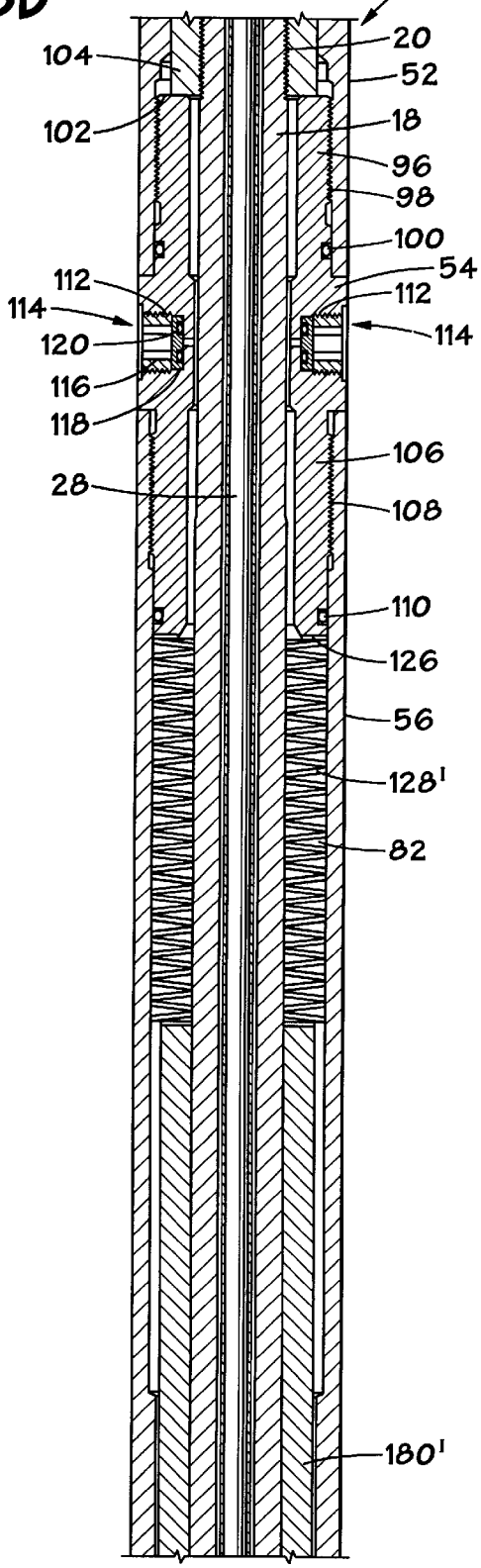

HYDRAULIC JAR

BACKGROUND OF THE INVENTION

1. Field of the Invention

This invention relates generally to downhole tools, and more particularly to a jar for inflicting axial force to a downhole string.

2. Description of the Related Art

In oil and gas well operations, it is frequently necessary to inflict large axial blows to a tool or tool string that is positioned downhole. Examples of such circumstances are legion. One situation frequently encountered is the sticking of drilling or production equipment in a well bore to such a degree that it cannot be readily dislodged. Another circumstance involves the retrieval of a tool or string downhole that has been separated from its pipe or tubing string. The separation between the pipe or tubing and the stranded tool or "fish" may be the result of structural failure or a deliberate disconnection initiated from the surface.

Jars have been used in petroleum well operations for several decades to enable operators to deliver such axial blows to stuck or stranded tools and strings. There are a few basic types. So called "drilling jars" are frequently employed when either drilling or production equipment has become stuck to such a degree that it cannot be readily dislodged from the well bore. The drilling jar is normally placed in the pipe string in the region of the stuck object and allows an operator at the surface to deliver a series of impact blows to the drill string via a manipulation of the drill string. These impact blows to the drill string are intended to dislodge the stuck object and permit continued operation. So called "fishing jars" are inserted into the well bore to retrieve a stranded tool or fish. Fishing jars are provided with a mechanism that is designed to firmly grasp the fish so that the fishing jar and the fish may be lifted together from the well. Many fishing jars are also provided with the capability to deliver axial blows to the fish to facilitate retrieval.

Jars capable of inflicting axial blows contain a sliding joint which allows a relative axial movement between an inner mandrel and an outer housing without allowing relative rotational movement therebetween. The mandrel typically has a hammer formed thereon, while the housing includes an anvil positioned adjacent to the mandrel hammer. Thus, by sliding the hammer and anvil together at high velocity, a substantial jarring force may be imparted to the stuck drill string, which is often sufficient to jar the drill string free. For most fishing applications it is desirable that the drilling jar be capable of providing both an upward and a downward jarring force.

There are four basic forms of jars: purely hydraulic jars, purely mechanical jars, bumper jars, and mechanical-hydraulic jars. The bumper jar is used primarily to provide a downward jarring force. The bumper jar ordinarily contains a splined joint with sufficient axial travel to allow the pipe to be lifted and dropped, causing the impact surfaces inside the bumper jar to come together to deliver a downward jarring force to the string.

Mechanical, hydraulic, and mechanical-hydraulic jars differ from the bumper jar in that they contain some type of triggering mechanism which retards the motion of the impact surfaces relative to each other until an axial strain, either tensile or compressive, has been applied to the drill string pipe. To provide an upward jarring force, the drill pipe is stretched by an axial tensile load applied at the surface. This tensile force is resisted by the triggering mechanism of the jar long enough to allow the pipe to stretch and store potential energy. When the jar triggers, this stored energy is converted to kinetic energy causing the impact surfaces of the jar to move together at a high velocity. To provide a downward jarring force, the pipe weight is slacked off at the surface and, if necessary, additional compressive force is applied, to put the pipe in compression. This compressive force is resisted by the triggering mechanism of the jar to allow the pipe to compress and store potential energy. When the jar triggers, the potential energy of the pipe compression and pipe weight is converted to kinetic energy causing the impact surfaces of the jar to come together at a high velocity.

The triggering mechanism in most mechanical jars consists of some type of friction sleeve coupled to the mandrel which resists movement of the mandrel until the load on the mandrel exceeds a preselected amount (i.e., the triggering load). The triggering mechanism in most hydraulic jars consists of one or more pistons which pressurize fluid in a chamber in response to movement by the mandrel. The compressed fluid resists movement of the mandrel. The pressurized fluid is ordinarily allowed to bleed off at a preselected rate. As the fluid bleeds off, the piston translates, eventually reaching a point in the jar where the chamber seal is opened, and the compressed fluid is allowed to rush out, freeing the mandrel to move rapidly.

Mechanical jars and hydraulic jars each have certain advantages over the other. Mechanical jars are generally less versatile and reliable than hydraulic jars. Many mechanical jars require the triggering load to be selected and preset at the surface to trigger at one specific load after the jar is inserted into the well bore. If it is necessary to re-adjust the triggering load, the jar must be pulled from the well bore. Other mechanical jars require a torque to be applied to the drill string from the surface in order to trigger the jar. The applied torque to the drill string not only represents a hazard to rig personnel, but torque cannot be applied to coiled tubing drill strings. Another significant disadvantage of mechanical jars is apparent in circumstances where the jar must be placed in a cocked position prior to insertion into the well bore. Thus, in those circumstances, the triggering mechanism is subjected to stresses during the normal course of if the jar is run as part of the bottom hole assembly. Finally, many mechanical jars have many surfaces that are subject to wear.

Hydraulic jars offer several advantages over purely mechanical jars. Hydraulic jars have the significant advantage of offering a wide variety of possible triggering loads. In the typical double acting hydraulic jar, the range of possible triggering loads is a function of the amount of axial strain applied by stretching or compressing the drill pipe, and is limited only by the structural limits of the jar and the seals therein. In addition, hydraulic jars are ordinarily less susceptible to wear and, therefore, will ordinarily function longer than a mechanical jar under the same operating conditions.

However, hydraulic jars also have certain disadvantages. For example, most purely hydraulic double acting jars are relatively long, in some instances having a length exceeding 25 feet. The length of a particular jar is ordinarily not a significant issue in drilling situations where regular threaded drill pipe is utilized. However, in coiled tubing applications, it is desirable that the length of all the tools in a particular drill string be no longer than the length of the lubricator of the particular coiled tubing injector. Thus, it is desirable that the jar be as short as possible to enable the operator to place as many different types of tools in the drill string as possible while still keeping the overall length of the drill string less than the length of the lubricator. A conventional hydraulic jar may take up one-half or more of the total length of a given lubricator, thus leaving perhaps less than half the length of the lubricator to accommodate other tools such as a mud motor, an orienting device, or a logging tool.

Many hydraulic jar designs also have a disadvantageously long metering stroke. The metering stroke is the amount of relative movement between the mandrel and the housing that must occur for the jar to trigger after it is cocked by application of an axial load. When an ordinary hydraulic jar is cocked by application of an axial load, fluid is pressurized in a chamber to resist relative movement of the mandrel and the housing. One or more metering orifices in the jar allow the compressed fluid to bleed off at a relatively slow rate. As the fluid is bleeding off, there is some relative axial movement between the mandrel and the housing. The amount of relative axial movement between the mandrel and the housing that occurs after the jar is cocked, but before the jar triggers, is known as bleed off. The bleed off represents lost potential energy that would ordinarily be converted into additional jarring force. Many current hydraulic jar designs have a relatively long metering stroke of 12 inches or more and, therefore, a significant amount of bleed off. A long metering stroke also leads to heat buildup in the hydraulic fluid, which may require costly intervals between firings and lead to degradation of fluid.

Mechanical-hydraulic jars ordinarily combine some features of both purely mechanical and purely hydraulic jars. For example, one design utilizes both a slowly metered fluid and a mechanical spring element to resist relative axial movement of the mandrel and the housing. This design has the same disadvantages associated with ordinary hydraulic jars, namely length, long metering stroke, and fluid heating. Another design utilizes a combination of a slowly metered fluid and a mechanical brake to retard the relative movement between the mandrel and the housing. In this design, drilling mud is used as the hydraulic medium. Therefore, the string must be pressurized before the jar will operate. This pressurization step will ordinarily require a work stoppage and the insertion of a ball into the work string to act as a sealing device. After the jar is triggered, the ball must be retrieved before normal operations can continue.

Some conventional jars employ a collet as a triggering mechanism. The collet is provided with one or more radially projecting flanges or teeth which engage a mating set of projections or channels in the mandrel. The engagement of the collet teeth and the mandrel teeth or channels restrains the longitudinal movement of the mandrel until some desired trigger point is reached. The trigger point frequently corresponds to the vertical alignment between the collet teeth and a channel or set of channels in the tool housing. At this point, the collet is no longer compressed radially inwardly and can expand rapidly in diameter to release the mandrel. The surfaces of the collet teeth and the channel or channels of the housing engaged just triggering may be subject to significant point loading, which can lead to rapid wear and the need for frequent repair. Furthermore, some conventional designs do not provide structure to prevent the premature expansion of the collet, which can otherwise lead to a sticking of the mandrel or a premature triggering. Premature triggering can lead to diminished overpull and application of less than desired axial force.

Many well operations are presently carried out with strings that utilize electrical power. Such tool strings are often suspended from conducting and non-conducting cables, such as wirelines and slicklines. In some wireline and slickline operations, it may be desirable to deploy ajar with tool string. If the jar is incapable of transmitting electrical power and signals, it must be positioned in the bottom hole assembly ("BHA") below the electrically powered components of the BHA. However, this may not be the optimum position for the jar in view of the operation to be performed.

The present invention is directed to overcoming or reducing the effects of one or more of the foregoing disadvantages.

SUMMARY OF THE INVENTION

In accordance with one aspect of the present invention, A jar is provided that includes a mandrel and a housing telescopically positioned about the mandrel. A piston is positioned between the mandrel and the housing and closes a substantially sealed chamber in the housing. The piston has a first flow passage and a second flow passage which enable the selective flow of a fluid into and out of the substantially sealed chamber. A collet is positioned in the housing for selectively engaging the mandrel. A sleeve is positioned around and axially moveable relative to the collet. The sleeve has a reduced inner diameter portion at which the collet selectively expands radially to disengage the mandrel.

In accordance with another aspect of the present invention, A jar is provided that includes a mandrel and a housing telescopically positioned about the mandrel. A piston is positioned between the mandrel and the housing and closes a substantially sealed chamber in the housing. The piston has a first flow passage and a second flow passage which enable selective flow of a fluid into and out of the substantially sealed chamber. A collet is positioned in the housing for selectively engaging the mandrel. A sleeve is positioned around and axially moveable relative to the collet. The sleeve has a reduced inner diameter portion at which the collet selectively expands radially to disengage the mandrel. A first biasing member is positioned between the mandrel and the housing. The first biasing member is operable to resist axial movement of the piston in a first direction.

In accordance with another aspect of the present invention, a jar is provided that includes a mandrel and a housing telescopically positioned about the mandrel. A piston is positioned between the mandrel and the housing and closes a substantially sealed chamber in the housing. The piston has a first flow passage and a second flow passage which enable selective flow of a fluid into and out of the substantially sealed chamber. A collet is positioned in the housing for selectively engaging the mandrel. A sleeve is positioned around and axially moveable relative to the collet. The sleeve has a reduced inner diameter portion at which the collet selectively expands radially to disengage the mandrel. A first biasing member is positioned between the mandrel and the housing and is operable to resist axial movement of the piston in a first direction. A second biasing member is provided to bias the sleeve to a preselected position until the collet expands radially.

In accordance with another aspect of the present invention, a jar is provided that includes a mandrel and a housing telescopically positioned about the mandrel. A collet is positioned in the housing for selectively engaging the mandrel. A sleeve is positioned around and is axially moveable relative to the collet. The sleeve has a reduced inner diameter portion at which the collet selectively expands radially to disengage the mandrel. A first biasing member is positioned in the housing to resist the axial movement of the mandrel.

BRIEF DESCRIPTION OF THE DRAWINGS

The foregoing and other advantages of the invention will become apparent upon reading the following detailed description and upon reference to the drawings in which:

FIGS. 1A–1D illustrate successive portions, in section, of an exemplary embodiment of a jar in its neutral position in accordance with the present invention;

FIG. 4 is a sectional view of FIG. 1B taken at section 4—4 in accordance with the present invention;

FIG. 7 is a sectional view of FIG. 1C taken at section 7—7 in accordance with the present invention;

FIGS. 8A–8D illustrate successive portions, in section, of the jar of FIGS. 1A–1D showing the jar in its fired position in accordance with the present invention;

FIG. 9 is a magnified view of selected portions of FIG. 8C in accordance with the present invention; and FIG. 10 is a sectional view like FIG. 1B depicting an alternate exemplary embodiment of the jar in accordance with the present invention.

DETAILED DESCRIPTION OF SPECIFIC EMBODIMENTS

Figure 1A:
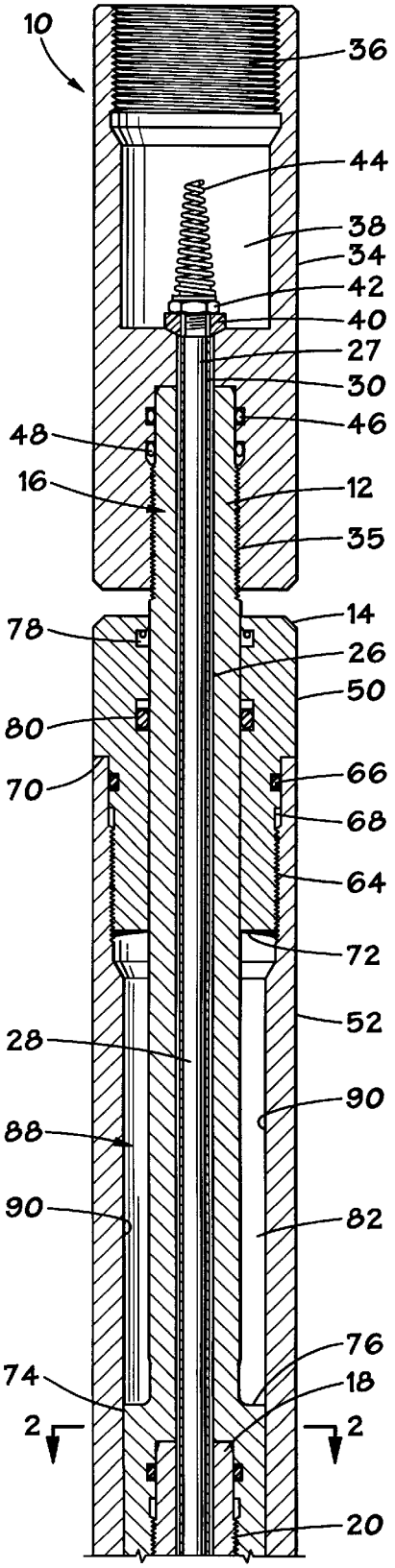

In the drawings described below, reference numerals are generally repeated where identical elements appear in more than one figure. Turning now to the drawings, and in particular to FIGS. 1A–1D, inclusive, there is shown an exemplary embodiment of a hydraulic jar 10 which is of substantial length necessitating that it be shown in four longitudinally broken sectional views, vis-a-vis FIGS. 1A, 1B, 1C and 1D. The jar 10 may be inserted into a well borehole (not shown) via a pipe, tubing or cable string as desired. FIGS. 1A–D show the jar 10 is a neutral or unfired condition. The jar 10 generally consists of an inner tubular mandrel 12 that is telescopingly supported inside an outer tubular housing 14. The mandrel 12 and the housing 14 each consists of a plurality of tubular segments joined together, preferably by threaded interconnections. The mandrel 12 consists of an upper tubular portion 16, an intermediate tubular portion 18 that is threadedly connected to the upper tubular portion 16 at 20, and a lower tubular portion 22 that is threadedly connected to the intermediate tubular portion 18 at 24. The mandrel 12 is provided with an internal longitudinal bore 26 that extends throughout the entire length thereof. An elongated conductor rod 27 is provided that consists of a segment 28 positioned in the bore 26 and electrically insulated from the mandrel 12 and the housing 14 by an insulating sleeve 30, and segment 31 positioned in the housing 14 (see FIG. 1D) and electrically insulated by an insulating sleeve 32. The segments 28 and 31 are electrically connected by a flexible conductor 33. The conductor rod 27 is designed to transmit electrical power and signals through the jar 10.

The upper end of the upper tubular section 16 of the mandrel 12 is threadedly connected to a connector sub 34 at 35. The connector sub 34 is provided with a female box connection 36 that is designed to threadedly receive the male end of another downhole tool or fitting (not shown). The upper end of the conductor rod 28 projects slightly out of the bore 26 and into a cylindrical space 38 in the connector sub 34. The segment 28 of the conductor rod 27 is electrically insulated from the surface of the cylindrical space 38 by an insulating ring 40 composed of Teflon, polyurethane or some other suitable insulating material. The conductor rod is fixed in position by a lock nut 42 that seats against the insulating ring 40. Electrical connection between the conductor rod 28 and another downhole tool or component position above the jar 10 may be by way of a coiled conductor 44 that is secured to the upper end of the conductor rod 28. The joint between the connector sub 34 and the upper tubular section 16 of the mandrel 12 is sealed against fluid passage by a pair of longitudinally spaced O-rings 46 and 48.

The housing 14 consists of an upper tubular section 50, an intermediate tubular section 52, an intermediate tubular section 54, an intermediate tubular section 56, an intermediate tubular section 58, an intermediate tubular section 60 and a bottom tubular section 62. The upper tubular section 50 is threadedly secured to the intermediate tubular section 52 at 64. The joint between the upper tubular section 50 and the intermediate tubular section 52 is sealed against fluid passage by an O-ring 66. The upper tubular section 50 includes a reduced diameter portion 68 that defines a downwardly facing annular surface 70 against which the upper end of the tubular section 52 is abutted and a downwardly facing annular anvil surface 72. The upper tubular section 16 of the mandrel 12 includes an expanded diameter portion 74 that defines an upwardly facing annular hammer surface 76. As described more fully below, when the mandrel 12 is moved axially upward relative to the housing 14 at high velocity, the hammer surface 76 is impacted into the downwardly facing anvil surface 72 to provide a substantial upward axial jarring force.

It is desirable to prevent mud or other material in the well from contaminating the jar operating fluid, and to prevent loss of jar operating fluid into the well. Accordingly, the upper tubular section 50 includes a seal arrangement that consists of a loaded lip seal 78 and an O-ring 80 positioned below the loaded lip seal 78.

A fluid chamber 82 is generally defined by the open internal spaces between the inner diameter of the housing 14 and the outer diameter of the mandrel 12. The chamber 82 extends generally longitudinally downward through the length of the housing 14 and is sealed at its lower end by a pressure compensating piston 84. The interior of the housing 14 below the pressure compensating piston 84 is vented to the well annulus by a plurality of ports 86 located in the intermediate tubular section 60. Tool working fluid is enclosed within the chamber 82 and permitted to pass back and forth through an actuating piston 87 that is positioned inside the intermediate tubular section 56. As described more fully below, the actuating piston 87 includes a flow restrictor which enables a significant over pull to be applied to the mandrel 12 followed by a gradual bleed off of fluid pressure through the piston 87 and eventual triggering of the jar 10. The working fluid may be hydraulic fluid, light oil or the like.

Figure 2:
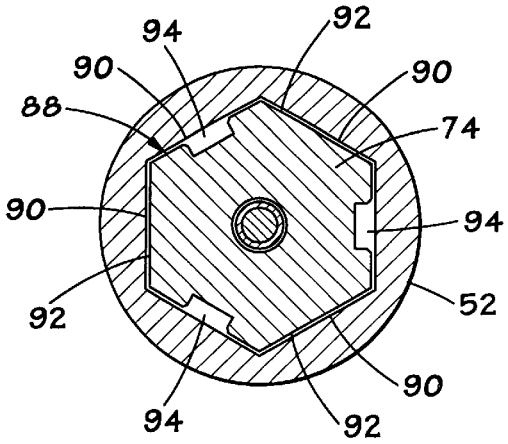
FIG. 2 is a sectional view of FIG. 1A taken at section 2—2 in accordance with the present invention.

Referring now also to FIG. 2, which is a sectional view of FIG. 1A taken at section 2—2, the interior surface 88 of the intermediate tubular section 52 is provided with a plurality of circumferentially spaced flats 90. The flats 90 are configured to slidedly mate with a matching set of external flats 92 fabricated on the exterior of the expanded diameter portion 74 of the mandrel 12. The sliding interaction of the flats 90 and 92 provide for relative sliding movement of the mandrel 12 and the housing 14 without relative rotational movement therebetween. To enable the working fluid of the jar 10 to readily flow past the expanded diameter portion 74, a plurality of external slots 94 are fabricated in one or more of the flats 92 to act as flow passages for the working fluid.

Figure 1B:
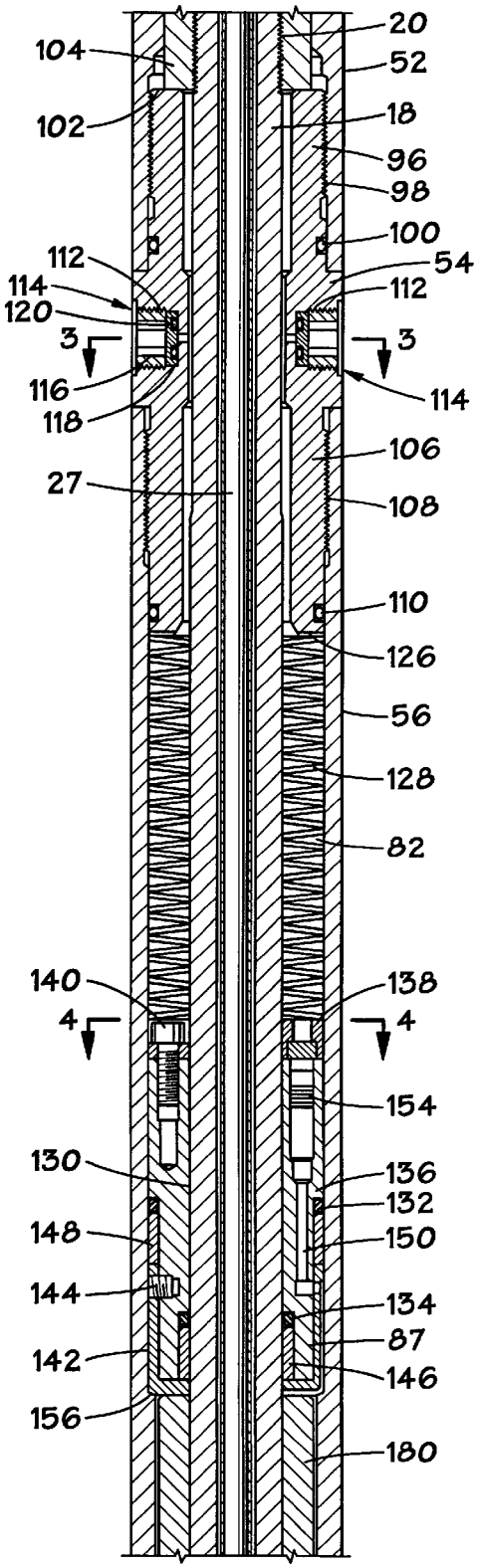
Figure 3:
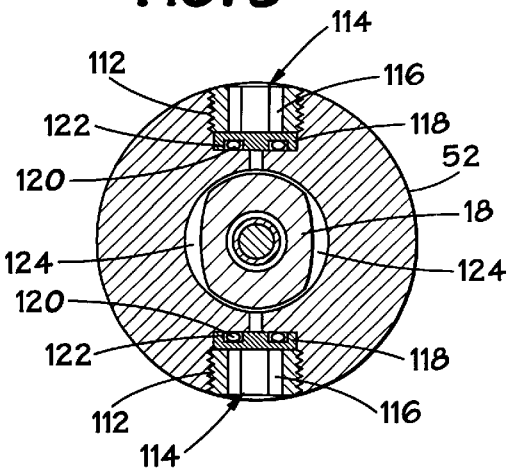
FIG. 3 is a sectional view of FIG. 1B taken at section 3—3 in accordance with the present invention.

Referring now to FIG. 1B, the intermediate tubular section 54 is provided with an upper reduced diameter portion 96 that is threadedly engaged to the lower end of the intermediate section 52 at 98. The joint between the intermediate section 52 and the upper reduced diameter portion 96 is sealed against fluid passage by an O-ring 100. The upper reduced diameter portion 96 defines an upwardly facing annular surface 102 against which the lower end 104 of the expanded diameter portion 74 of the mandrel 12 may seat. The annular surface 102 represents the lower limit of downward axial movement of the mandrel 12 relative to the housing 14. The intermediate section 54 includes a substantially identical lower reduced diameter portion 106 that is threadedly engaged to the upper end of the intermediate section 56 at 108. The joint between the lower expanded diameter section 106 and the intermediate tubular section 56 is sealed against fluid passage by an O-ring 110. Referring now also to FIG. 3, which is a sectional view of FIG. 1B taken at section 3—3, the intermediate section is provided with one or more fill ports 112 which are capped by fluid plugs 114. Each of the fluid plugs 114 consists of a hex nut 116 that compresses a sealed disk 118 that is provided with an O-ring 120 and a seal ring 122. The seal ring 122 is located at the outer diameter of the O-ring 120 and is not called out in FIG. 1B with a separate element number for simplicity of illustration. The fill ports 112 are designed to permit the filling of the fluid chamber 82 with hydraulic fluid.

The wall thickness of the intermediate section 54 in the vicinity of the fill ports 112 must be thick enough to accommodate the profiles of the plugs 114 while providing sufficient material to withstand the high pressures associated with the operation of the jar 10. This entails a relatively tight tolerance between the inner diameter of the intermediate section 54 and the intermediate section 18 of the mandrel 12, and would otherwise constitute a significant restriction to the passage of hydraulic fluid past the intermediate section 18. To alleviate this potential flow restriction, the intermediate section 18 of the mandrel 12 is provided with an oval cross section as shown that defines circular segment-like flow passages 124 on either side thereof.

The lower end 108 of the tubular section 54 defines a downwardly facing annular surface 126 against which the upper end of a biasing member 128 bears. The biasing member 128 advantageously consists of a stack of bellville springs, although other types of spring arrangements may be possible, such as one or more coil springs. As described more fully below, the biasing member 128 is designed to resist upward axial movement of the actuating piston 87 and to return the actuating piston 87 to the position shown in FIG. 1B after an upward jarring movement of the jar 10. The biasing member 128 also provides the jar 10 with a preload that enables the operator to apply an upward axial force on the mandrel 12 without necessarily commencing a triggering cycle. For example, the biasing member 128 may be configured to apply a 1000 lb. downward force on the mandrel 12 with the jar 10 in the position shown in FIGS. 1A–1D. So long as the upward axial force applied to the mandrel 12 does not exceed this preload, the jar 10 will not begin a triggering cycle. In this way, the operator is provided with flexibility in pulling on the components coupled to the jar 10. Optionally, the biasing member 128 may be eliminated and hydraulic pressure used alone.

The detailed structure of the actuating piston 87 may be understood by referring now to FIGS. 1B and 4, which is a sectional view of FIG. 1B taken at section 4—4. The actuating piston 87 provides a mechanism for substantially sealing the portion of the fluid chamber 82 disposed above it to permit a build up of pressure therein. In this way, the hydraulic chamber 82 resists the upward movement of the mandrel 12 relative to the housing 14. That is, upward relative movement of the mandrel 12 relative to the housing 14 reduces the volume of the portion of the hydraulic chamber 82 above the actuating piston 87, causing a significant increase in the internal pressure of that portion of the chamber 82, and thereby generating an axial force to resist this relative movement. This resistance to relative movement allows a large buildup of potential energy.

The actuating piston 87 has a relatively smooth cylindrical bore 130 through which the mandrel 12 is slidably disposed and is sealed against the leakage of fluid around its exterior surface and past the mandrel 12 by a pair of O-rings 132 and 134 that are, respectively, positioned proximate the outer surface and inner surface of the actuating piston 87. The actuating piston 87 includes a tubular piston body 136 that is capped by an annular cap 138. The cap 138 is secured to the body 136 by four hex socket cap screws 140. The lower end of the body 136 is jacketed by a bearing ring 142 that is secured in place by one or more set screws 144. A support ring 146 is positioned between the O-ring 134 and an upwardly facing annular surface of the bearing ring 142. A similar ring 148 is positioned between the O-ring 132 and the upper end of the bearing ring 142. The actuating piston 87 has two substantially parallel flow passages 150 and 152. The first flow passage 150 is designed to permit the restrictive flow of fluid from the portion of the chamber 82 positioned above the piston 87 to permit the build up of pressure in the chamber 82 above the piston 87 while simultaneously permitting the actuating piston 87 to move upwards until the jar 10 triggers as described more fully below. In this regard, the upper portion of the first flow passage 150 includes a conventional flow restriction orifice 154. A variety of well known flow restriction devices may be used. In an exemplary embodiment, the flow restriction orifice 154 is a Visco Jet model 187. The second flow passage 152 also extends from the upper end of the actuating piston 87 and terminates below the O-ring 132 leading to the flow passage defined by the gap between the outer diameter of the bearing ring 142 and the inner diameter of the intermediate tubular section 56. The flow passage 152 is designed to prevent the flow of fluid from the portion of the hydraulic chamber 82 through the actuating piston 87 during the upward movement thereof, while permitting a free flow of fluid in the reverse direction during the downward movement of the actuating piston 87. In this regard, the flow passage 152 includes a conventional one-way flow valve, that is not visible in FIG. 1B or FIG. 4. The one-way flow valve may be any of a variety of conventional designs. In an exemplary embodiment, the flow valve is a Lee Chek model 187, manufactured by the Lee Company of West Brook, Conn. In the embodiment illustrated, the flow passages 150 and 152 terminate at their lower ends in a 90° elbow. This configuration is necessary only to avoid the O-ring 132. However, it should be understood that the flow passages 150 and 152 may alternatively extend through the entire length of the piston 87, thus obviating the need for the 90° elbows and the annular gap between the bearing ring 142 and the interior surface of the tubular section 56. The intermediate tubular section 56 includes a reduced diameter portion that defines an upwardly facing annular shoulder 156 against which the lower end of the piston 87 is seated. This shoulder 156 defines the lower limit of downward movement of the actuating piston 87.

Referring now to FIGS. 1B and 1C, it should be appreciated that the actuating piston 87, in conjunction with the fluid pressure in the portion of the chamber 82 above the piston 87 and the biasing member 128, function to retard the upward movement of the mandrel 12 to allow a build-up of potential energy in the working string when a tensile load is placed on the mandrel 12 from the surface. This transmission of an upward acting force on the mandrel 12 to the actuating piston 87 requires a mechanical linkage between the mandrel 12 and the actuating piston 87. This mechanical linkage is provided by a generally tubular collet 158 that is positioned within the tubular section 56. The mandrel 12, and more specifically the intermediate tubular section 18 thereof extends through the collet 158.

Figure 5:
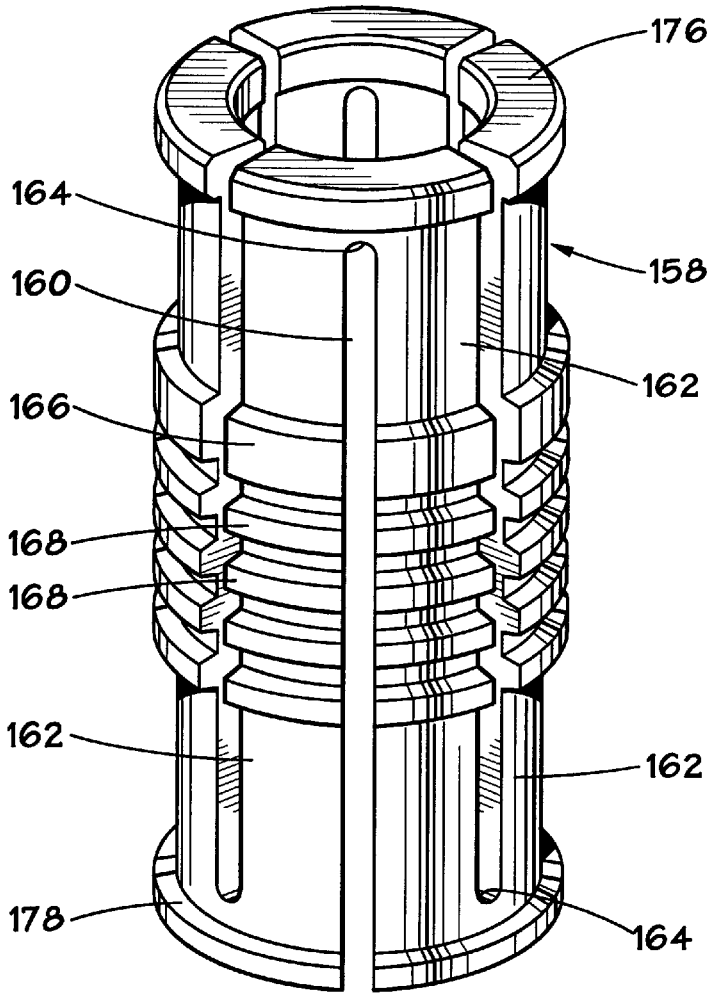
FIG. 5 is a pictorial view of an exemplary collet of the jar of FIGS. 1A–1D in accordance with the present invention.

The detailed structure of the collet 158 may be understood by referring now also to FIG. 5, which is a pictorial view of the collet removed from the jar 10. The collet 158 has a plurality of longitudinally extending and circumferentially spaced slots 160 that divide the central portion of the collet 158 into a plurality of longitudinally extending and circumferentially spaced segments 162. During the operation of the jar 10, the segments 162 will be subjected to bending stresses. Accordingly, it is desirable to round the ends 164 of the slots 160 to avoid creating stress risers. Each of the longitudinal segments 162 has an outwardly projecting primary member or flange 166 and a plurality of outwardly projecting secondary members or flanges 168. The primary flange 166 is located above the secondary flanges 168 and has a greater width than the secondary flanges 168. The internal surface of each segment 162 is provided with a primary inwardly facing member or flange 170 and a plurality of secondary inwardly facing members or flanges 172. The exterior surface of the section 18 of the mandrel 12 is provided with a plurality of external grooves or flanges 174 which are configured to mesh with the primary and secondary inwardly facing flanges 170 and 172 of the collet 158.

The upper and lower ends of the collet 158 terminate in respective annular flat surfaces 176 and 178. A compression ring 180 is positioned between the upper annular surface 176 and the lower end of the bearing ring 142 on the actuating piston 87. So long as the inwardly facing flanges 170 and 172 of the collet 158 are retained in physical engagement with the flanges 174 of the mandrel section 18, axial force applied to the mandrel 12 will be transmitted through the collet 158 and to the compression ring 180 and thus the actuating piston 87.

A tubular sleeve 182 is positioned around the collet 158 and inside the intermediate tubular section 56. The sleeve 182 is positioned in an expanded diameter section of the intermediate section 156 that defines a downwardly facing annular surface 184 which defines the upward limit of axial movement of the sleeve 182. The upper end of the sleeve 182 is provided with a reduced diameter portion consisting of a plurality of inwardly projecting flanges 185 which are separated by a corresponding plurality of grooves 186 which are sized and configured to receive the outwardly projecting secondary flanges 168 of the collet 158, when the tool 10 is triggered. When an upward axial force is applied to the mandrel 12, the collet 158 moves slowly upward axially until sufficient pressure has bled from the high pressure side of the chamber 82. At the moment when the outwardly projecting secondary flanges 168 are in alignment with the grooves 186 of the sleeve 182, the collet segments 162 expand radially outwardly until the flanges 168 seat in the grooves 186. At this point, the mandrel 12 is released from the retarding action of the collet 158 and allowed to rapidly accelerate upwards, propelling the hammer surface 76 into the anvil surface 72.

Figure 6:
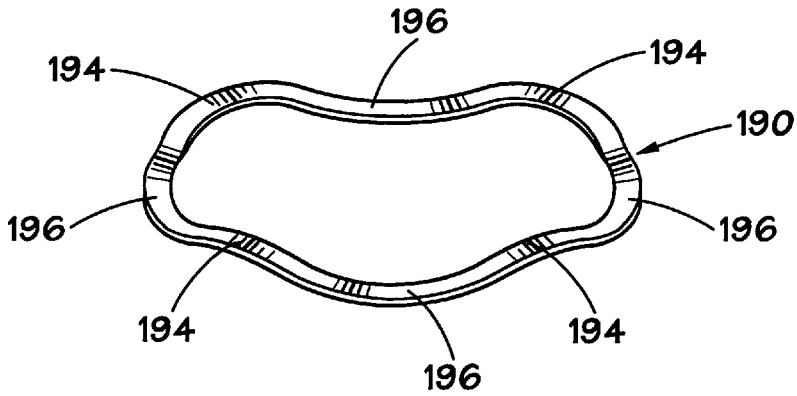
FIG. 6 is a pictorial view of an exemplary biasing member of the jar of FIGS. 1A–1D in accordance with the present invention.

The lower end of the sleeve 182 terminates in a downwardly facing annular surface 188, which is seated on a biasing member 190. The biasing member 190 is, in turn, seated on the upwardly facing annular surface 192 of the intermediate tubular section 58. The biasing member 190 may be wave spring, a coil spring or other type of biasing member. In an exemplary embodiment, the biasing member 190 is a wave spring. FIG. 6 depicts a pictorial view of an exemplary wave spring biasing member 190. As shown in FIG. 6, the biasing member 190 includes a plurality of peaks 194 which are in physical contact with the lower end of the sleeve 182 and a plurality of troughs 196 that are normally in contact with the upwardly facing annular surface 192. The biasing member 190 is designed to bias the sleeve 182 upward until the flanges 168 and the grooves 186 are aligned. At this point, the biasing member 190 enables the sleeve 182 to move axially downward slightly to complete the triggering of the jar 10. This function will be described in more detail below.

Referring again to FIG. 1C, the lower end of the intermediate tubular section 56 is threadedly engaged to the upper end of the intermediate tubular section 58 at 198. That joint is sealed against fluid passage by an O-ring 200.

The lower end of the intermediate tubular section 58 includes an expanded diameter region 202 that provides an annular space for the sliding movement of the compensating piston 84. The compensating piston 84 is journalled about the lower tubular portion 22 of the mandrel 12 and is designed to ensure that the pressure of the fluid acting on the lower side of the piston 87 is substantially equal to the annulus pressure. The compensating piston 84 is sealed internally, that is, against the surface of the mandrel section 22 by an O-ring 204 and a longitudinally spaced loaded lip seal 206. The piston 84 is sealed externally, that is, against the interior surface of the expanded diameter section 202 by an O-ring 208 and an longitudinally spaced lip seal 210 that are substantially identical to the O-ring 204 and the lip seal 206. The lower end of the intermediate tubular section 58 is threadedly engaged to the upper end of the intermediate tubular section 60 at 212. That joint is sealed by an O-ring 214.

The threaded joint between the intermediate mandrel section 18 and the lower mandrel section 22 is sealed against fluid passage by an O-ring 216. Like the expanded diameter section 74 of the upper mandrel section 16, the exterior of the upper end 218 of the lower mandrel tubular section 22 is provided with an external hexagonal shape, as better seen in FIG. 7, which is a sectional view of FIG. 1C taken at section 7—7. The hex cross-section provides flat surfaces to facilitate the threaded joining of the sections 18 and 22 and to provide flow passages for fluid to move past the the tubular section 22.

Figure 1D:
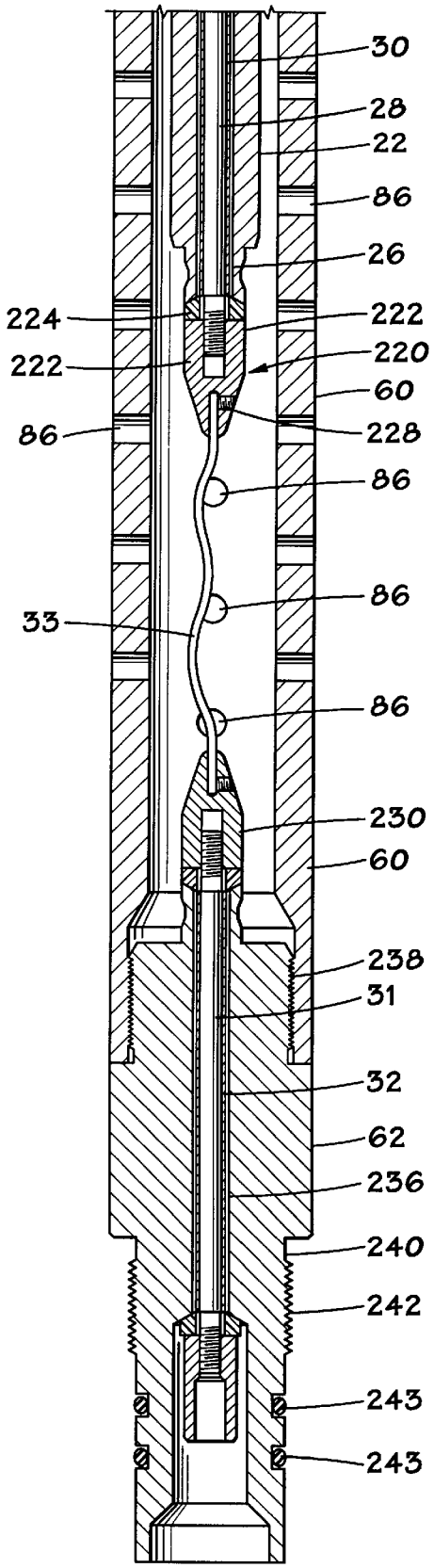

The lower end of the jar 10 will now be described. Referring to FIG. 1D, the lower end of the lower tubular mandrel section 22 terminates in an electrical connector assembly 220 that includes a conducting tip member 222 that is threadedly secure to the lower end of the segment 28 of the conductor rod 27. The tip 222 may be composed of a variety of conducting metallic materials, such as, for example, brass, mild carbon steel, or the like. In an exemplary embodiment, the tip 222 is composed of brass. The tip 222 is electrically insulated from the mandrel section 22 by an insulating spacer ring 224 that may be composed of a variety of well known insulating plastic materials. The flexible conductor 33 secured to the tip 222 by a set screw 228. The flexible conductor 33 is advantageously a jacketed conductor or set of conductors that permit the transmittal of electrical current from the conductor rod segment 28 to another electrical connector assembly 230 coupled to the conductor rod segment 31 that is substantially identical to the connector assembly 220, albeit in a flip-flopped orientalion. Note that the flexible conductor 33 is provided with a significant amount of slack. This is necessary to enable the conductor 33 to be stretched out axially when the mandrel 12 is moved axially upward. The lower end of the electrical connector assembly 230 is threadedly engaged with the conductor rod segment 31. The conductor rod segment 31 is positioned in a bore 236 in the bottom tubular section 62. The bottom tubular section is threadedly engaged to the lower end of the intermediate tubular section 60 at 238. The lower end 240 of the bottom tubular section 62 may be provided with a reduced diameter, a set of external threads 242 and a pair of O-rings 243 to facilitate interconnection with another downhole tool or component of a bottom hole assembly.

A variety of materials may be used to fabricate the larger components of the jar 10. Examples include mild and alloy steels, stainless steels or the like. Wear surfaces, such as the exterior of the mandrel 12, may be carbonized to provided a harder surface.

The jarring movement of the jar 10 may be understood by referring to FIGS. 1A–1D inclusive, and FIGS. 8A–8D inclusive. FIGS. 8A–8D show the jar 10 just after it has fired. In an unloaded condition, the jar 10 is in a neutral position as depicted in FIGS. 1A–1D, inclusive. To initiate a jarring movement of the jar 10, an upwardly directed tensile load is applied to the mandrel 12 via the connector sub 34. The range of permissible magnitudes of tensile loads, and thus the imparted upward jarring force, is limited only by the structural limits of the jar 10 and the seals therein and by the string or wireline that is supporting the jar 10. As force is applied to the mandrel 12, upward axial force is transmitted to the collet 158 through the engagement of the external flanges 174 of the mandrel 12 with the inwardly facing flanges 170 and 172 of the collet 158. The upper annular surface 176 of the collet is then brought into engagement with the compression ring 180. If the applied load exceeds the preload of the biasing member 128, the actuating piston 87 is moved axially upward slightly, compressing the hydraulic fluid enclosed within the chamber 82. The upward movement of the actuating piston 87, and in turn, the collet 158 and the mandrel 12 are retarded by the pressure of the fluid compressed within the portion of the hydraulic chamber 82 above the actuating piston 87 and by the downward acting force of the biasing member 128, allowing potential energy in the string to build. As noted above, upward axial movement of the actuating piston 87 is accommodated by a restricted flow of hydraulic fluid from the high pressure side of the chamber 82 through the flow passage 154. The actuating piston 87, the collet 158 and the mandrel 12 continue a steady but slow upward creep as fluid continues to flow from the high pressure side of the chamber 82 down through the actuating piston 87 and into the lower reaches of the chamber 82.

When the primary outwardly facing flanges 166 of the collet 158 just clear the upper end of the sleeve 182, the outwardly projecting flanges 168 will be in substantial alignment with the channels 186 of the sleeve 182. At this point, the segments 162 may expand radially outwardly enough so that the outwardly projecting flanges 174 of the mandrel 12 clear the inwardly projecting flanges 170 and 172 of the collet 158, thereby allowing the mandrel 12 to translate upwards freely and rapidly relative to the housing 14. Without the strictures of the collet 158 and the actuating piston 87, the mandrel 12 accelerates upward rapidly bringing the hammer surface 76 of the mandrel 12 rapidly into contact with the anvil surface 72 of the tubular section 50 of the housing 14, as shown in FIG. 8A. If tension on the mandrel 12 is released, the biasing member 128 urges the piston 87 downward to the position shown in FIG. 1B. This downward movement is accompanied by a flow of fluid up through the piston 87.

The collet 158 provides for relatively short firing or metering stroke. The metering stroke is defined approximately by the distance between the primary flanges 166 and the lowermost secondary flanges 168. This relatively short metering stroke minimizes bleed off or lost potential energy and minimizes the amount of working fluid that must pass through the piston, thereby reducing heat buildup on the fluid.

The collet 158 is provided with a plurality of principal outwardly projecting flanges 166 that are wider than the channels 186 in the sleeve 182. This deliberate mismatch in dimensions is designed to prevent one or more of the secondary outwardly projecting flanges 168 from prematurely engaging and locking into one of the lower channels 186. Such a premature engagement between the outwardly projecting secondary flanges 168 and the channels 186 might prevent the additional axial movement of the mandrel 12 or result in a premature release of the mandrel 12 and thus insufficient application of upward jarring force.

The function of the biasing member 190 depicted in FIG. 1C may be understood by referring now to FIG. 9, which is a magnified sectional view of the portions of FIG. 1C circumscribed generally by the dashed ovals 244 and 246. The collet 158 is shown following substantial upward axial movement and just prior to triggering via radially outward movement of the secondary outwardly projecting flanges 168 into the channels 186 of the sleeve 182. When the collet 158 is moved to the position shown in FIG. 9, which is just prior to triggering, point loading occurs between the surfaces 248 of the outwardly projecting flanges 168 and the surfaces 250 of the sleeve 182. This point loading would last for some interval as the collet 158 moves upward and until the beveled surfaces of the flanges 172 begin to slide outwardly along the beveled surfaces of the channel 186. If the sleeve 182 is held stationary during this operation, the point loading between the surfaces 248 and 250 can result in significant wear of those corner surfaces. However, the biasing member 190 enables the point loading at the surfaces 248 and 250 to move the sleeve 180 axially downward in the direction of the arrow 252 and compress the biasing member 190. This downward axial movement of the sleeve 182 enables the flanges 172 to quickly slide into the channels 186 and minimize the duration of the point loading between the surfaces 248 and 250. In this way, the wear of the corner surfaces 248 and 250 are significantly reduced. This function may be served even with without the biasing member 190.

An alternate exemplary embodiment of the jar, now designated 10', may be understood by referring now to FIGS. 1A, 1C, 1D and to FIG. 10, which a sectional view like FIG. 1B. This alternate embodiment may be substantially identical to the embodiment of the jar 10 depicted in FIGS. 1A–1D with a notable exception. In this illustrative embodiment, the aforementioned actuating piston 87 (See FIG. 1B) is eliminated and the resistance to upward movement of the mandrel 12 is provided only by the biasing member, now designated 128', and any frictional forces acting on the sliding surfaces of the moving parts. Axial force applied to the mandrel 12 is transferred to the biasing member 128' through direct physical contact with the sleeve 180'. Hydraulic fluid is still present in the chamber 82 to lubricate the sliding parts. The biasing member 128' is configured to provide a known downward force when compressed to the point where the collet 158 triggers. In this way, the biasing member 128' may be configured at the surface so that the jar 10' will provide a known upward jarring force when triggered.

To trigger the jar 10', upward axial force is applied to the mandrel 12. If the axial force exceeds the preload of the biasing member 128', the sleeve 180' and the mandrel 12 will movement upward, compressing the biasing member 128'. If the applied load is great enough to compress the biasing member 128' far enough for the collet 158 to reach its trigger point, the jar 10' will trigger and deliver an axial blow.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A jar, comprising:

a mandrel;

a housing telescopically positioned about the mandrel;

a piston positioned between the mandrel and the housing and closing a substantially sealed chamber in the housing, the piston having a first flow passage and a second flow passage for enabling selective flow of a fluid into and out of the substantially sealed chamber;

a collet positioned in the housing for selectively engaging the mandrel; and a sleeve positioned around and being axially moveable relative to the collet, the sleeve having a reduced inner diameter portion at which the collet selectively expands radially to disengage the mandrel.

2. The jar of claim 1, comprising a first biasing member positioned between the mandrel and the housing, the first biasing member being operable to resist axial movement of the piston in a first direction.

3. The jar of claim 2, wherein the first biasing member comprises a plurality of stacked bellville springs.

4. The jar of claim 1, comprising a second biasing member to bias the sleeve to a preselected position until the collet expands radially.

5. The jar of claim 4, wherein the second biasing member comprises a wave spring.

6. The jar of claim 1, wherein the reduced inner diameter portion of the sleeve comprises a plurality of annular channels and wherein the collet comprises a plurality of longitudinally extending, circumferentially spaced segments, at least two of the segments having a plurality of outwardly projecting members, one of the plurality of outwardly projecting members being sized larger than the plurality of channels and the remainder being sized to respectively fit into the plurality of channels.

7. A jar, comprising:

a mandrel;

a housing telescopically positioned about the mandrel;

a piston positioned between the mandrel and the housing and closing a substantially sealed chamber in the housing, the piston having a first flow passage and a second flow passage for enabling selective flow of a fluid into and out of the substantially sealed chamber;

a collet positioned in the housing for selectively engaging the mandrel;

a sleeve positioned around and being axially moveable relative to the collet, the sleeve having a reduced inner diameter portion at which the collet selectively expands radially to disengage the mandrel; and a first biasing member positioned between the mandrel and the housing, the first biasing member being operable to resist axial movement of the piston in a first direction.

8. The jar of claim 7, wherein the first biasing member comprises a plurality of stacked bellville springs.

9. The jar of claim 7, comprising a second biasing member to bias the sleeve to a preselected position until the collet expands radially.

10. The jar of claim 9, wherein the second biasing member comprises a wave spring.

11. The jar of claim 7, wherein the reduced inner diameter portion of the sleeve comprises a plurality of annular channels and wherein the collet comprises a plurality of longitudinally extending, circumferentially spaced segments, at least two of the segments having a plurality of outwardly projecting members, one of the plurality of outwardly projecting members being sized larger than the plurality of channels and the remainder being sized to respectively fit into the plurality of channels.

12. A jar, comprising:

a mandrel;

a housing telescopically positioned about the mandrel;

a piston positioned between the mandrel and the housing and closing a substantially sealed chamber in the housing, the piston having a first flow passage and a second flow passage for enabling selective flow of a fluid into and out of the substantially sealed chamber;

a collet positioned in the housing for selectively engaging the mandrel;

a sleeve positioned around and being axially moveable relative to the collet, the sleeve having a reduced inner diameter portion at which the collet selectively expands radially to disengage the mandrel;

a first biasing member positioned between the mandrel and the housing, the first biasing member being operable to resist axial movement of the piston in a first direction: and a second biasing, member to bias the sleeve to a preselected position until the collet expands radially.

13. The jar of claim 12, wherein the first biasing member comprises a plurality of stacked bellville springs.

14. The jar of claim 12, wherein the second biasing member comprises a wave spring.

15. The jar of claim 12, wherein the reduced inner diameter portion of the sleeve comprises a plurality of annular channels and wherein the collet comprises a plurality of longitudinally extending, circumferentially spaced segments, at least two of the segments having a plurality of outwardly projecting members, one of the plurality of outwardly projecting members being sized larger than the plurality of channels and the remainder being sized to respectively fit into the plurality of channels.

16. A jar, comprising:

a mandrel;

a housing telescopically positioned about the mandrel;

a collet positioned in the housing for selectively engaging the mandrel;

a sleeve positioned around and being axially moveable relative to the collet, the sleeve having a reduced inner diameter portion at which the collet selectively expands radially to disengage the mandrel; and a first biasing member positioned in the housing to resist the axial movement of the mandrel.

17. The jar of claim 16, wherein the first biasing member comprises a plurality of stacked beliville springs.

18. The jar of claim 16, comprising a second biasing member to bias the sleeve to a preselected position until the collet expands radially.

19. The jar of claim 18, wherein the second biasing member comprises a wave spring.

20. The jar of claim 16, wherein the reduced inner diameter portion of the sleeve comprises a plurality of annular channels and wherein the collet comprises a plurality of longitudinally extending, circumferentially spaced segments, at least two of the segments having a plurality of outwardly projecting members, one of the plurality of outwardly projecting members being sized larger than the plurality of channels and the remainder being sized to respectively fit into the plurality of channels.

* * * * *